United States Patent [19]

Shinzawa et al.

[11] Patent Number: 4,812,262

[45] Date of Patent: Mar. 14, 1989

[54] FIRE-RETARDANT ELECTRIC DEVICE

[75] Inventors: Akira Shinzawa; Yoshiki Kohno, both of Yokohama, Japan

[73] Assignee: Nippon Oil Co., Ltd., Tokyo, Japan

[21] Appl. No.: 147,247

[22] Filed: Jan. 22, 1988

[30] Foreign Application Priority Data

Jan. 30, 1987 [JP] Japan ..... 62-18628

[51] Int. Cl.[4] ..... H01B 3/20

[52] U.S. Cl. ..... 252/567; 252/579; 336/94

[58] Field of Search ..... 252/567, 579; 336/94

[56] References Cited

U.S. PATENT DOCUMENTS 3,740,625 6/1973 Ross et al. ..... 252/579
3,925,221 12/1975 Eustance ..... 252/579

FOREIGN PATENT DOCUMENTS 1012621 6/1977 Canada ..... 252/579
49/29500 3/1974 Japan .
1602092 11/1981 United Kingdom ..... 252/579

*Primary Examiner*—Robert A. Wax
*Attorney, Agent, or Firm*—Bucknam and Archer

[57] ABSTRACT

An electric device particularly adapted for a fire retardant oil-filled transformer, comprising a cellulose-based insulating material impregnated with an insulating oil composed of 100 parts by weight of an ester of a polyol with a fatty acid having a fire point of 300° C. or above and, incorporated therein, 0.005 to 1.0 part by weight of a phenolic compound having no alkyl groups as the substituent at the ortho positions and 0.01 to 2.0 parts by weight of an epoxy compound.

5 Claims, No Drawings

FIRE-RETARDANT ELECTRIC DEVICE

BACKGROUND OF THE INVENTION

1. Field of the Invention

This invention relates to a fire-retardant electric device, particularly a transformer conforming with the standards of a fire retardant oil-immersed transformer as prescribed in Item 450-23 of U.S. NEC (National Electrical Code).

2. Prior Art

Fire-retardant transformers which have heretofore been put to practical use include a dry-type transformer, an insulating oil-free transformer such as a $SF_6$ gas-filled one, and a transformer of the type in which the insulating material is impregnated with a fire-retardant insulating oil such as a silicone oil or a mineral oil having a high fire point.

They raise, however, problems as to their expensiveness or limitation on performance. In order to solve these problems, there was proposed the use of a tetraester, synthesized from pentaerythritol and a saturated fatty acid, as the electrical insulating oil (see Japanese Pat. Appln. Laid-Open No. 49-29500). The use of such an insulating oil alone, however, does not satisfy the requirements as prescribed in JIS (C-2320) particularly in respect of antioxidizing performance.

SUMMARY OF THE INVENTION

The present invention relates to an electric device comprising a cellulose-based insulating material impregnated with an insulating oil composed of 100 parts by weight of an ester, having a fire point of 300° C. or above, of a polyol with a fatty acid, 0.005 to 1.0 part by weight of a phenolic compound having no alkyl substituents at the ortho positions and 0.01 to 2.0 parts by weight of an epoxy compound.

The present invention will now be described in more detail.

The ester of a polyol with a fatty acid used in the present invention is preferably an ester of trimethylolpropane with a fatty acid represented by the general formula (1) or an ester of pentaerythritol with a fatty acid represented by the general formula (2):

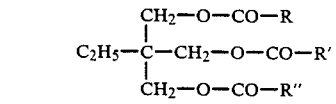

(1)

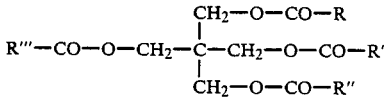

(2)

In the formulae (1) and (2), R, R′, R″, and R‴ are each a saturated or unsaturated chain hydrocarbon group represented by the formula $C_nH_{2n+1}$ (wherein n is an integer of 4 to 15, preferably 5 to 10), and they may be the same or different. They should, however, be a fatty acid ester having a fire point of 300° C. or above.

The larger the number of carbon atoms of R, R′, R″ or R‴, is, the higher the fire point of the ester is. However, this gradually increases the kinematic viscosity of the ester, while the ester gradually lowers in cooling capacity as an electrical insulating oil. In the present invention, a particularly preferable ester is an ester of pentaerythritol with a mixture of fatty acids respectively of the formulae $C_nH_{2n+1}$—COOH wherein n is 6 and 7. The phenolic compounds used herein and having no alkyl substituents at the ortho positions include 4-tert.-butylcatechol, hydroquinone, 4-tert.-octylphenyl salicylate, 1,1′-bis(4-hydroxyphenyl)cyclohexane, β-naphthol, and 4,4′-isopropylidenebisphenol, among which 4,4′-isopropylidenebisphenol is particularly preferable.

The phenolic compound is used in an amount of 0.005 to 1.0 part by weight, preferably 0.01 to 0.5 part by weight based on 100 parts by weight of an ester of a polyol with a fatty acid.

The epoxy compounds used in the present invention include an epoxy compound of glycidyl ester type, an epoxy compound of glycidyl ether type, an aromatic epoxy compound, and an epoxidized vegetable oil.

The epoxy compound is used in an amount of 0.01 to 2.0 parts by weight, preferably 0.05 to 1.0 part by weight based on 100 parts by weight of an ester of a polyol with a fatty acid.

If necessary, a metal inactivating agent such as benzotriazole, may be added to the insulating oil used in the present invention.

Further, a mineral insulating oil having a fire point of 300° C. or above may also be added to the insulating oil of the present invention.

DESCRIPTION OF THE PREFERRED EMBODIMENTS

The present invention will now be described in more detail with reference to the following examples which should not be construed as limiting the scope of the present invention.

EXAMPLE 1

0.05 parts by weight of 4-tert.-butylcatechol and 0.5 parts by weight of an epoxy compound (trade name: ERL-4221) were incorporated in 100 parts by weight of an ester of pentaerythritol with a fatty acid the ester having a kinetic viscosity (at 40° C.) of 24.5 cSt and a fire point of 308° C. This ester exhibited excellent results, i.e. an acid value of 0.06 mg KOH/g, in the test for oxidation stability (JIS C 2101). This ester was heated and kept at 150° C. for 10 days in a hermetically sealed container which had simulated a transformer (in the presence of kraft paper and metallic copper). The acid value of the ester after the heating was 0.12 mg KOH/g, and the retentivity of tensile strength of the kraft paper was 70%.

COMPARATIVE EXAMPLE 1

The same ester of pentaerythritol with a fatty acid as that of Example 1 exhibited a poor result when used alone, i.e., an acid value of 1.5 mg KOH/g in the test for oxidation stability (JIS C 2101).

EXAMPLE 2

0.1 part by weight of 4,4′-isopropylidenebisphenol and 0.3 parts by weight of an epoxy compound of glycidyl ester type (trade name: Cardura E 10) were incorporated in 100 parts by weight of the same ester of pentaerythritol with a fatty acid as that of Example 1. This ester exhibited excellent oxidation stability (JIS C 2101), i.e., an acid value of 0.03 mg KOH/g. This ester was heated in the presence of kraft paper and metallic copper under the same conditions as those of Example 1. The acid value of the ester after the heating was as low as 0.05 mg KOH/g, and the retentivity of tensile strength of the kraft paper was 72%.

COMPARATIVE EXAMPLE 2

The same test as that of Example 2 was conducted except that 0.1 part by weight of common di-tert.-butyl-p-cresol was used instead of 4,4'-isopropylidenebisphenol used in Example 2. The resulting ester exhibited an acid value of 0.1 mg KOH/g in the test for oxidation stability (JIS C 2101). This ester was heated in the presence of kraft paper and metallic copper. The acid value of the ester after the heating was relatively low, i.e., 0.15 mg KOH/g, however the retentivity of tensile strength of the kraft paper was as low as 39%.

As is apparent also from the above Examples, the electric device of the present invention comprising a cellulose-based insulating material impregnated with a specific insulating oil exhibits excellent fire retardation and excellent performance as an electric device.

What is claimed is:

1. An electric device comprising a cellulose-based insulating oil composed of 100 parts by weight of a fatty acid polyol ester having a fire point of at least 300° C., 0.005 to 1.0 part by weight of a phenolic compound having no alkyl substituents at the ortho positions, wherein said phenolic compound is 4 tert.-butylcatechol, 4-tert.-octylphenyl salicylate, 1,1'-bis(4-hydroxyphenyl)cyclohexane, $\beta$-naphthol or 4,4'-isopropylidenebisphenol, and 0.01 to 2.0 parts by weight of an epoxy compound.

2. An electric device according to claim 1, wherein said fatty acid polyol ester is an ester of trimethylolpropane with a fatty acid represented by the following general formula (1)

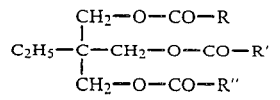

(1)

or an ester of pentaerythritol with a fatty acid represented by the following general formula (2)

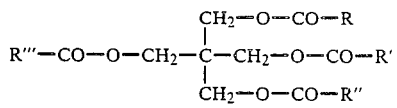

(2)

wherein R, R', R'' and R''' are each a saturated or unsaturated chain hydrocarbon group represented by the formula $C_nH_{2n+1}$ wherein n is an integer of 4 to 15 and they are the same or different.

3. The device according to claim 2 wherein said hydrocarbon group of formula $C_nH_{2n+1}$ is of 5–10 carbon atoms.

4. The device according to claim 1 wherein the phenol is 4-tert-butylcatechol, and is formed from pentaerythritol and has kinetic viscosity at 40° C. of 25.5 c ST and fire point of 308° C.

5. The device according to claim 1 wherein the phenol is 4,4'-isopropylidene bis-phenol.

* * * * *